US008708597B2

(12) United States Patent
Barrett et al.

(10) Patent No.: US 8,708,597 B2
(45) Date of Patent: Apr. 29, 2014

(54) SYSTEM AND METHOD FOR INCREASING ROADWAY WIDTH INCORPORATING A REVERSE ORIENTED RETAINING WALL AND SOIL NAIL SUPPORTS

(71) Applicants: Robert K. Barrett, Grand Junction, CO (US); Albert C. Ruckman, Pallsade, CO (US); Timothy Allen Ruckman, Phoenix, AZ (US); Colby Barrett, Grand Junction, CO (US); Cameron Lobato, Grand Junction, CO (US); Nathan Beard, Fruita, CO (US)

(72) Inventors: Robert K. Barrett, Grand Junction, CO (US); Albert C. Ruckman, Pallsade, CO (US); Timothy Allen Ruckman, Phoenix, AZ (US); Colby Barrett, Grand Junction, CO (US); Cameron Lobato, Grand Junction, CO (US); Nathan Beard, Fruita, CO (US)

(73) Assignee: R&B Leasing, LLC, Grand Junction, CO (US)

( * ) Notice: Subject to any disclaimer, the term of this patent is extended or adjusted under 35 U.S.C. 154(b) by 0 days.

(21) Appl. No.: 13/749,269

(22) Filed: Jan. 24, 2013

(65) Prior Publication Data

US 2013/0136538 A1 May 30, 2013

Related U.S. Application Data

(63) Continuation of application No. 12/785,321, filed on May 21, 2010, now Pat. No. 8,376,661.

(51) Int. Cl.
*E02D 17/20* (2006.01)

(52) U.S. Cl.
USPC ..... 404/72; 405/302.7; 405/262

(58) Field of Classification Search
CPC ..... E02D 17/20
USPC ..... 404/72; 405/15, 259.1, 259.5, 262, 272, 405/302.4, 302.6, 302.7
See application file for complete search history.

(56) References Cited

U.S. PATENT DOCUMENTS 250,134 A 11/1881 Coy
332,359 A 12/1885 Paine (Continued)

FOREIGN PATENT DOCUMENTS

CN 2905900 5/2007
EP 0307291 3/1989

(Continued)

OTHER PUBLICATIONS

U.S. Appl. No. 13/586,683, filed Aug. 15, 2012, Barrett et al.

(Continued)

*Primary Examiner* — Tara M. Pinnock
(74) *Attorney, Agent, or Firm* — Sheridan Ross PC

(57) ABSTRACT

A system and method are provided for increasing the width of an existing roadway. The system incorporates a reverse-oriented retaining wall and soil nail supports. The retaining wall is formed by a first set of soil nails, wire mesh material, and one or more geotextile material layers. An alternate embodiment forms the retaining wall with a plurality of concrete blocks stacked and spaced to form a block wall. The blocks are mounted over the first set of nails. Backfill material fills a gap between the existing sloping surface and the retaining wall. A second set of soil nails can be provided for additional subsurface support. An upper surface of the backfill material can be paved to form the extended roadway width.

22 Claims, 9 Drawing Sheets

(56) References Cited

U.S. PATENT DOCUMENTS

| | | | | | |
|---|---|---|---|---|---|
| 571,225 | A | | 11/1896 | Geisel | |
| 1,163,981 | A | | 12/1915 | Dodds | |
| 1,188,914 | A | | 6/1916 | Dodds | |
| 1,271,151 | A | | 7/1918 | Frauenheim | |
| 1,597,573 | A | | 8/1926 | Blue | |
| 2,314,897 | A | | 3/1943 | Purinton | |
| 2,667,037 | A | | 1/1954 | Thomas et al. | |
| 3,047,036 | A | | 7/1962 | Waltermire | |
| 3,060,694 | A | | 10/1962 | Holmes | |
| 3,226,933 | A | | 1/1966 | White | |
| 3,286,416 | A | | 11/1966 | Ashworth | |
| 3,371,494 | A | | 3/1968 | Lagerstrom | |
| 3,469,491 | A | | 9/1969 | Munsey | |
| 3,487,646 | A | | 1/1970 | Gatien | |
| 3,490,242 | A | | 1/1970 | Schnabel | |
| 3,491,497 | A | | 1/1970 | Bauer | |
| 3,496,729 | A | | 2/1970 | Pleuger | |
| 3,680,274 | A | | 8/1972 | Deike | |
| 3,753,354 | A | | 8/1973 | Bauer | |
| 3,807,182 | A | | 4/1974 | Schnabel | |
| 3,808,624 | A | | 5/1974 | Barkdull, Jr. | |
| 3,893,274 | A | | 7/1975 | Salisbury | |
| 3,971,177 | A | | 7/1976 | Endo | |
| 3,979,918 | A | | 9/1976 | Vidler | |
| 3,981,038 | A | | 9/1976 | Vidal | |
| 3,999,391 | A | | 12/1976 | Meredith | |
| 4,024,719 | A | * | 5/1977 | Risseeuw | 405/232 |
| 4,124,983 | A | | 11/1978 | Weatherby | |
| 4,132,080 | A | | 1/1979 | Hansen | |
| 4,181,995 | A | | 1/1980 | Zur | |
| 4,247,225 | A | | 1/1981 | Chickini et al. | |
| 4,253,781 | A | | 3/1981 | Fischer et al. | |
| 4,274,762 | A | | 6/1981 | Johnson | |
| 4,284,379 | A | | 8/1981 | Chaiko | |
| 4,302,131 | A | | 11/1981 | Brown | |
| 4,323,657 | A | | 4/1982 | Mazanek et al. | |
| 4,360,292 | A | | 11/1982 | Keeler et al. | |
| 4,386,877 | A | | 6/1983 | McDowell, Jr. | |
| 4,397,589 | A | | 8/1983 | Darroussin et al. | |
| 4,479,748 | A | | 10/1984 | Uhlmann | |
| 4,490,074 | A | | 12/1984 | Chaiko | |
| 4,502,818 | A | | 3/1985 | Elders | |
| 4,564,313 | A | | 1/1986 | Niswander et al. | |
| 4,564,967 | A | | 1/1986 | Vidal | |
| 4,571,124 | A | | 2/1986 | Matsui et al. | |
| 4,584,247 | A | | 4/1986 | Mulholland | |
| 4,607,984 | A | | 8/1986 | Cassidy | |
| 4,610,568 | A | | 9/1986 | Koerner | |
| 4,619,559 | A | | 10/1986 | Norris | |
| 4,636,115 | A | | 1/1987 | Davis et al. | |
| 4,648,753 | A | | 3/1987 | Stephan | |
| 4,666,345 | A | | 5/1987 | Seegmiller | |
| 4,712,957 | A | | 12/1987 | Edwards et al. | |
| 4,728,225 | A | * | 3/1988 | Brandl et al. | 405/262 |
| 4,856,952 | A | | 8/1989 | Shaw | |
| 4,940,365 | A | | 7/1990 | Rozanc | |
| 4,952,097 | A | * | 8/1990 | Kulchin | 405/262 |
| 4,954,017 | A | | 9/1990 | Davis et al. | |
| 4,993,872 | A | | 2/1991 | Lockwood | |
| 5,017,047 | A | | 5/1991 | Myles et al. | |
| 5,044,831 | A | | 9/1991 | Myles et al. | |
| 5,054,146 | A | | 10/1991 | Wiesenfeld et al. | |
| 5,076,734 | A | | 12/1991 | Hipkins | |
| 5,127,783 | A | | 7/1992 | Moghe et al. | |
| 5,192,168 | A | | 3/1993 | Massarsch et al. | |
| 5,192,169 | A | | 3/1993 | Landsberg | |
| 5,222,850 | A | | 6/1993 | Medal | |
| 5,234,291 | A | | 8/1993 | Swemmer | |
| 5,263,291 | A | | 11/1993 | Knight | |
| 5,273,377 | A | | 12/1993 | Taylor | |
| 5,297,900 | A | | 3/1994 | Witzand | |
| 5,472,296 | A | | 12/1995 | Von Allmen et al. | |
| 5,494,378 | A | | 2/1996 | Hanson | |
| 5,542,785 | A | | 8/1996 | Cloud | |
| 5,549,418 | A | | 8/1996 | Devine et al. | |
| 5,551,810 | A | * | 9/1996 | Franceski et al. | 405/286 |
| 5,588,784 | A | * | 12/1996 | Brandl et al. | 405/262 |
| 5,634,752 | A | | 6/1997 | Haage et al. | |
| 5,647,709 | A | | 7/1997 | Hein et al. | |
| 5,649,790 | A | | 7/1997 | Mergen et al. | |
| 5,653,557 | A | | 8/1997 | Gruber | |
| 5,669,199 | A | | 9/1997 | Ludwig et al. | |
| 5,688,077 | A | | 11/1997 | Kynoch | |
| 5,709,332 | A | | 1/1998 | Coop | |
| 5,713,162 | A | | 2/1998 | Gallo et al. | |
| 5,713,701 | A | | 2/1998 | Marshall | |
| 5,730,565 | A | | 3/1998 | Hein et al. | |
| 5,829,922 | A | | 11/1998 | Calandra, Jr. et al. | |
| 5,864,993 | A | | 2/1999 | Wells | |
| 5,890,843 | A | | 4/1999 | Bastick et al. | |
| 5,921,715 | A | | 7/1999 | Rainey | |
| 5,927,905 | A | | 7/1999 | Van Halteren | |
| 5,931,606 | A | | 8/1999 | Karlsen | |
| 5,934,836 | A | | 8/1999 | Rupiper et al. | |
| 5,984,588 | A | | 11/1999 | Ferrari | |
| 6,280,120 | B1 | | 8/2001 | Okamoto et al. | |
| 6,299,386 | B1 | | 10/2001 | Byrne et al. | |
| 6,514,012 | B2 | | 2/2003 | Gregory et al. | |
| 6,524,027 | B1 | | 2/2003 | Fabius | |
| 6,533,498 | B1 | | 3/2003 | Quin | |
| 6,565,288 | B1 | | 5/2003 | McCallion | |
| 6,652,195 | B2 | | 11/2003 | Vickars et al. | |
| 6,742,976 | B2 | | 6/2004 | Groll | |
| 6,745,421 | B2 | | 6/2004 | Barrett et al. | |
| 6,776,242 | B1 | | 8/2004 | Cunningham | |
| 6,796,745 | B2 | | 9/2004 | Kulchin | |
| 6,820,379 | B1 | | 11/2004 | Krinner et al. | |
| 6,874,975 | B2 | | 4/2005 | Hilfiker et al. | |
| 6,890,127 | B1 | | 5/2005 | Barrett et al. | |
| 6,926,186 | B2 | | 8/2005 | Wells | |
| 6,931,805 | B2 | | 8/2005 | Gregory et al. | |
| 7,025,016 | B1 | | 4/2006 | Landes | |
| 7,037,058 | B2 | | 5/2006 | Fergusson | |
| 7,040,850 | B2 | | 5/2006 | Gaudron | |
| 7,226,247 | B2 | | 6/2007 | Barrett et al. | |
| 7,309,199 | B2 | | 12/2007 | Ayrle | |
| 7,338,233 | B2 | | 3/2008 | Barrett et al. | |
| 7,377,725 | B2 | * | 5/2008 | Cammack | 405/284 |
| 7,384,217 | B1 | | 6/2008 | Barrett et al. | |
| 7,478,986 | B2 | | 1/2009 | Bushell et al. | |
| 7,507,048 | B2 | | 3/2009 | Colarusso et al. | |
| 7,513,728 | B1 | | 4/2009 | Seace | |
| 7,736,738 | B2 | | 6/2010 | Simmons et al. | |
| 8,376,661 | B2 | | 2/2013 | Barrett et al. | |
| 2001/0046418 | A1 | | 11/2001 | Lay | |
| 2002/0108348 | A1 | | 8/2002 | Yukimoto et al. | |
| 2003/0099518 | A1 | | 5/2003 | Barley | |
| 2004/0031214 | A1 | | 2/2004 | Fong et al. | |
| 2004/0109729 | A1 | | 6/2004 | Hilfiker et al. | |
| 2004/0161305 | A1 | | 8/2004 | Simmons et al. | |
| 2004/0202512 | A1 | | 10/2004 | Smith | |
| 2005/0097849 | A1 | | 5/2005 | Hayes | |
| 2007/0172315 | A1 | | 7/2007 | Barrett et al. | |
| 2007/0292231 | A1 | | 12/2007 | Boot et al. | |
| 2008/0193225 | A1 | | 8/2008 | Melegari | |
| 2010/0054866 | A1 | | 3/2010 | Barrett et al. | |
| 2010/0166505 | A1 | | 7/2010 | Barrett et al. | |
| 2010/0166506 | A1 | | 7/2010 | Barrett et al. | |

FOREIGN PATENT DOCUMENTS

| | | |
|---|---|---|
| GB | 2289078 | 11/1995 |
| JP | 3-257216 | 11/1991 |
| JP | 8-189035 | 7/1996 |
| JP | 2004-027813 | 1/2004 |
| WO | WO 03/035988 | 5/2003 |
| WO | WO 2005/098165 | 10/2005 |

OTHER PUBLICATIONS

Symons, "Concrete forming and shoring systems," Dayton Superior, accessed on Sep. 1, 2010, available at http://www.symons.com/div3/liners.htm, 1 page.

(56) References Cited

OTHER PUBLICATIONS

FiReP® "Rebar Technology—Durability for the Future," date unknown, pp. 1-27.

"Composite Self-Drilling Soil Nails," Weldgrip Geotechnical brochure, date unknown, 2 pages.

"Poly(Vinyl Chloride)," Copyright 1996, available at http://www.psrc.usm.edu/macrog/pvc.htm, 3 pages.

Colorado Department of Transportation Bridge Design Manual Section Seven, Substructures (Sections 7.1-7.3), Nov. 2, 1987, 11 pages.

"The Soil Nail Launcher, Where Speed, Cost and the Environment are Important," Colorado DOT Demonstration, available at http://www.soilnaillauncher.com, date unknown, 1 page.

* cited by examiner

SYSTEM AND METHOD FOR INCREASING ROADWAY WIDTH INCORPORATING A REVERSE ORIENTED RETAINING WALL AND SOIL NAIL SUPPORTS

CROSS-REFERENCE TO RELATED APPLICATIONS

This Application is a Continuation of U.S. patent application Ser. No. 12/785,321, filed on May 21, 2010, entitled "System and Method For Increasing Roadway Width Incorporating A Reverse Oriented Retaining Wall and Soil Nail Supports".

FIELD OF THE INVENTION

The present invention relates generally to systems and methods for constructing and repairing roadways, and more particularly, to a system and method for increasing the width of a roadway by incorporating a reverse-oriented retaining wall and subsurface soil nail supports.

BACKGROUND OF THE INVENTION

In the construction of buildings, bridges, and other man-made structures, it is well-known to place passive supports such as footers, piles, and other subsurface installations for supporting above ground structures. Subsurface supports can be generally classified in two types. Passive supports are those that require the earth around the subsurface support to first shift or move to mobilize the available tensile, bending, or shear capacities of the subsurface supports. Active supports are those that are pre-tensioned to prevent shifts in the earth.

It is known to provide ground strengthening by driving, drilling, or launching elongate reinforcing members, referred to as soil nails, into the ground in a pattern, thus improving the bulk properties of the ground. Soil nails in generally horizontal orientations are used to prevent shifting or other undesirable movement of a particular geological formation. Soil nails installed in vertical orientations can also add to the bearing capacity of a foundation and can be referred to also as mircropiles. When soil nails are pretensioned, they can be referred to as tiebacks or tendons.

In some circumstances, the earth surrounding or under a man-made structure becomes unstable and therefore requires active supports, such as tie-backs, that are pre-tensioned subsurface installations used to restrain movement of the surrounding soil and rock. Recently, soil nails and tie-backs have been used to provide both temporary and permanent excavation support and slope stabilization.

Mountainous terrain provides a challenge for road designers to provide the required roadway width. Two significant regulatory changes over recent years have made roadway construction and maintenance particularly challenging for mountainous areas. The first regulatory change includes Federal and State Highway Safety Standards in which new roads must comply with stricter specifications regarding the size of the roadway width and shoulder, as well as other design specifications, such as the allowable slope, grade, and radius for curves. In some cases, if an existing roadway is repaired or modified, it may have to comply with the more strict design specifications therefore requiring the road to be widened.

The other significant regulatory change is limitations on disruption of the surrounding environment in order to reduce the environmental impact of roads located in State or Federally protected lands. Road widening efforts such as blasting or significant earth removal may not comply with environmental impact standards, thus preventing or greatly inhibiting the ability to widen a roadway.

Therefore, there is a need to provide a system and method for increasing the width of a roadway that complies with current Federal and State regulatory schemes. There is also a need to provide such a system and method that is not cost prohibitive and is relatively easy to install. There is yet another need to provide a system and method for increasing a roadway width in which the solution is adaptable for diverse environments.

SUMMARY OF THE INVENTION

In accordance with the present invention, a system and method are provided for increasing roadway widths by incorporating reverse-oriented retaining walls and soil nail supports.

In a preferred embodiment of the invention, the system comprises a retaining wall that serves as the exterior lateral support for a roadway in order to widen the existing roadway. The system of the invention is particularly advantageous for widening a roadway in mountainous or hilly terrain where one lateral side of the road is located adjacent to a vertical drop, such as a cliff or hillside.

The retaining wall is characterized as "reverse-oriented" because when the viewing the retaining wall at a vertical cross-section, the retaining wall extends at a reverse angle with respect to the horizontal plane of the roadway.

The system is constructed with a number of soil nails that tie into the retaining wall from the surrounding geological formation. A first set of nails are placed at a location which defines the position of the reverse-oriented retaining wall and therefore also delimit the additional width of the road to be added with the system. This first set of soil nails can also be referred to as micropiles that act to support the system in compression, shear, and bending. This first set of soil nails may be installed according to various methods, including the use of self-drilling soil nails that may be installed by drilling, or the use of a soil nail launcher which launches the soil nails into the sloping surface. The first set of soils nails are selectively spaced apart from one another along a length that corresponds to the length of the retaining wall to be constructed. A wire mesh material is laid over the first set of soil nails and is tied to the soil nails. A layer of geosynthetic fabric is then placed over the wire mesh material and secured to the wire mesh. The first set of nails, wire mesh, and geosynthetic material form the exterior wall of the retaining wall system. Alternatively, in lieu of geosynthetic fabric and wire mesh, concrete masonry unit (CMU) blocks may be used for the exterior wall of the system. The first set of nails are routed through the interior openings of the CMU blocks, and the CMU blocks are stacked and spaced to form a block wall with mortar placed between the blocks in a conventional brick and mortar construction. The interior cavities of the blocks may also be filled with mortar to further secure the blocks to the first set of soil nails. Unlike a traditional retaining wall; however, the lowermost row of blocks does not have to be supported with separate footers or other types of subsurface supports. Rather, the remaining length of the first set of soil nails embedded into the adjacent slope serve to anchor the blocks. Alternatively, in lieu of CMU Blocks, conventional concrete forming techniques may be used to construct a cast-in-place concrete structural wall centered about the vertical support elements, namely, the first set of soil nails.

A second set of soil nails may be used to further strengthen the roadway extension. The second set of soil nails generally extend at a more horizontal angle as compared to the first set of nails, and the second set of nails may extend further under the existing roadway. The second set of nails may be tied to the first set of soil nails. The second set of nails act primarily in tension, but also may carry shear and bending loads depending upon the horizontal angle. Once each of the sets of soil nails, wire mesh, and fabric are in place, the gap between the retaining wall and existing slope is backfilled with desired materials, including soil, rock, concrete mix, and combinations thereof. Once the backfill material has cured, the upper surface of the backfill may be paved thereby forming the increased roadway width. One or more bearing plates can be connected to any of the sets of nails to further stabilize the second set of nails within the backfill material.

Additional internal support for the retaining wall may be provided by a plurality of shear resisting soil nails, referred to herein as dowels, that are embedded in the existing slope. Typically, the shear resistance soil nails or dowels have a smaller length than the first and second set of nails.

The lateral ends or sides of the retaining wall can taper or reduce in width to terminate as necessary to accommodate the surrounding terrain. The retaining wall may have lateral ends that abruptly terminate because of the abrupt end of a sloping surface adjacent the roadway or the retaining wall may slowly taper to a reduced width taking into account an adjacent sloping surface that does not abruptly end and rather more gradually ends over a distance. In either case, the width of the retaining wall can be adjusted to follow the natural terrain and the existing roadway path.

A roadway barrier may be installed on the upper surface of the roadway extension. Such barriers may include known concrete barriers or other barriers to prevent a vehicle from traveling beyond the outer lateral edge of the roadway extension.

For aesthetic purposes, the exposed surface of the retaining wall may be coated with a cement or plaster material, and painted or stained to match the characteristics of the surrounding environment. The exposed surface may also include a decorative exterior liner that facilitates painting/staining, or may itself be colored and/or textured as to provide the desired appearance.

In one embodiment, the retaining wall takes advantage of the use of form panels, such as used in concrete construction, in which the form panel delimits the exposed surface of the retaining wall. The fill material located against the form panel may include concrete, thereby forming an exterior concrete wall for the retaining wall system. The form panels are removed after the concrete has cured. The use of a decorative exterior liner is particularly advantageous with the use of form panels in which the panels are stripped away to expose the exterior liner.

In order to tie the exposed ends of the soil nails to one another and to otherwise interconnect the parts of the soil nails that extend into the retaining wall, traditional wire or tie rods can be used. Alternatively, the ends of the nails may include couplers that interconnect the ends of the nails with a length of cable that is then used to tie to the other nails or to other structural members in the retaining wall. The desired number and orientation of the cables can be provided for interconnecting the soil nails and to also supplement the structural support provided by the soil nails.

The reverse-oriented retaining wall of the present invention provides significant savings in terms of the amount of required backfill materials as well as construction materials, as compared to traditional construction designs. As one skilled in the art may appreciate, a prior art retaining wall is a vertical installation that commences at the surface of the adjacent sloping surface. In the case of extreme sloping surfaces or cliffs, a retaining wall may often have to be built hundreds of feet below the roadway. A large amount of backfill material is required since the backfill material must fill the entire gap between the retaining wall and the sloping surface. Gaining access to the location where the retaining wall may have to commence may be difficult for large vehicles, thereby increasing the difficulty of constructing the retaining wall. Obstructions may also require the retaining wall to be built a considerable lateral distance from the existing roadway which, increase overall cost and effort in using a retaining wall to widen the road.

Other features and advantages of the present invention will become apparent by a review of the following figures when taken in conjunction with the detailed description.

DETAILED DESCRIPTION

Figure 1:
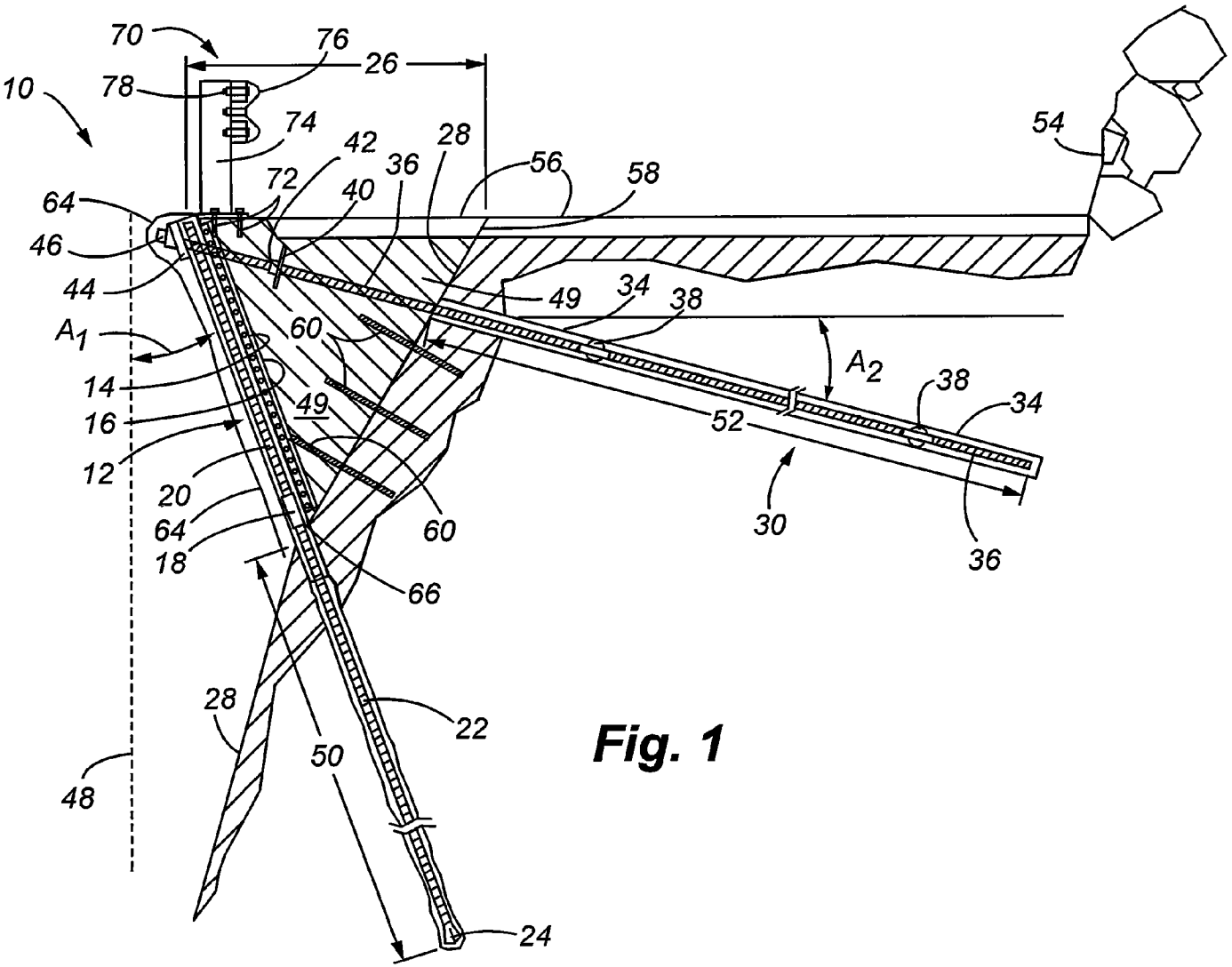
FIG. 1 is a cross-sectional view of the system of the present invention in a first embodiment.
Figure 3:
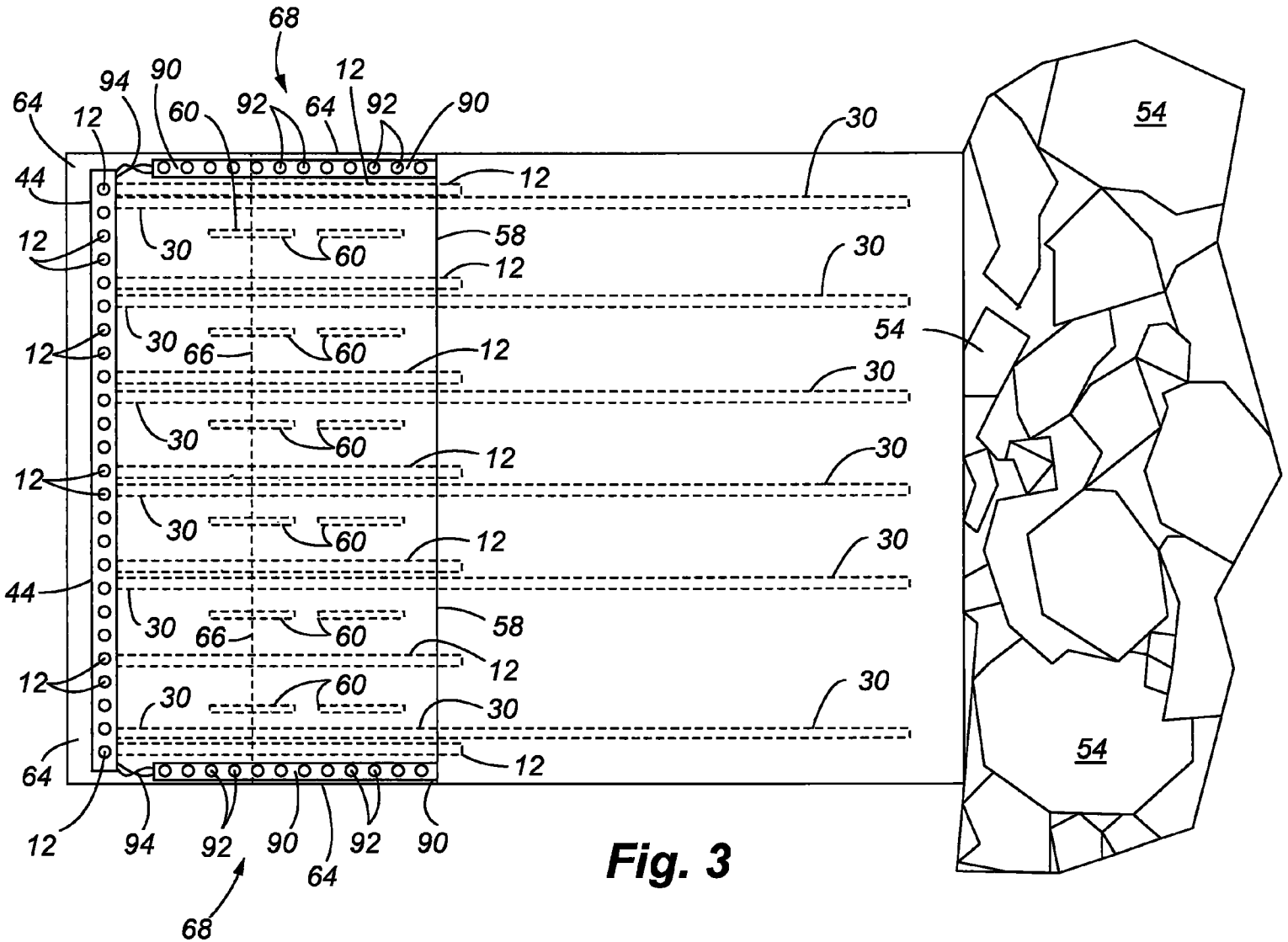
FIG. 3 is a plan view of the invention of FIG. 1.

FIGS. 1 and 3 show the system of the invention in a first embodiment. The system includes a retaining wall 10 that is used to widen an existing roadway. A sloping surface 28 normally limits the width of the roadway on one lateral side of the road. The retaining wall components include a first set of soil nails 12 that are secured in the sloping surface 28. As best seen in FIG. 3, a plurality of the first set of nails 12 is spaced apart from one another along a length of the retaining wall 10. The angular extension of the soil nails 12 can be measured, for example, from a vertical angle $A_1$. This angular extension generally defines the exterior face of the retaining wall as discussed further below. The first set of soil nails thereby form a first means for supporting the sloping surface.

Once the first set of nails 12 are installed, a wire mesh material 14 is placed over the exposed portions of the soil nails 12. The wire mesh is secured to the soil nails 12 using, for example, adequate wire ties or other hardware. One or more geosynthetic or geotextile layers 16 are then placed over the wire mesh 14, thus forming a semi-permeable layer, which may allow drainage of moisture through the layers. The type of wire mesh 14 and geotextile layer(s) 16 may be selected to match the required design specifications in terms of the strength of the retaining wall 10 as well the degree to which drainage is required. In particular, in wet climates, it may be advantageous to provide more permeable types of geotextile layer(s) 16. The wire mesh material and geotextile layers, either alone or in combination, thereby form a means for forming a barrier that defines the exterior shape of the retaining wall.

In the preferred embodiment of FIG. 1, the soil nails 12 may comprise more than one piece or section, namely, a lower section 22 that is buried within the slope 28 and an upper exposed section 20 that attaches to the exposed end of the lower section 22 as by a coupler 18. The distal or lower end of the lower section 22 may include a self-drilling bit 24. The depth 50 that the lower section 22 is embedded in the sloping surface 28 will vary depending upon the type of soil/rock making up the sloping surface 28. For less compacted soils, it may be necessary to bury the lower section 22 at a greater depth 50 to ensure the soil nail 12 is properly supported. As mentioned above, it is contemplated that one method of emplacement for the lower section 22 is by drilling the soil nails 12 in place. Alternatively, the soil nails 12 could be emplaced as by use of a soil nail launcher. The type of soil nail illustrated as soil nail 12 in FIG. 1 can be that of the soil nails more particularly set forth in our co-pending application Ser. No. 12/646,672, entitled "COMPOSITE SELF-DRILLING SOIL NAIL AND METHOD," this application incorporated herein by reference for purposes of disclosing the construction of this type of soil nail 12.

A second set of soil nails 30 are provided to strengthen the retaining wall, and are preferably anchored to the upper exposed ends 20 of the first set of nails 12. The second set of nails 30 may be two piece soil nails in which an outer portion comprises an outer tube 34, an inner member 36 extends through the outer tube 34 and maintains a spaced concentric relationship with the outer tube 34 as by use of one or more centering features 38. The second set of nails 30 are disposed at a more horizontal angle as compared to the first set of soil nails 12, wherein the horizontal angle is measured as angle $A_2$ from the horizontal. The depth 52 to which the nail 30 is buried in the sloping surface 28 may again vary based on the type of soil/rock formation encountered. The exposed portion of the inner member 36 may include one or more steel bearing plates 40, attached to the inner member 36, and secured in place as by one or more securing nuts 42. The type of soil nail illustrated as soil nail 30 in FIG. 1 can be that of the soil nail disclosed in our other co-pending application Ser. No. 12/646,573, entitled "SELF-CENTRALIZING SOIL NAIL AND METHOD OF CREATING SUBSURFACE SUPPORT," this application also incorporated herein by reference for purposes of disclosing this two piece soil nail construction.

The connection between the first 12 and second 30 set of soil nails may be facilitated by use of a longitudinal steel waler or bar 44, in which the free ends of the inner members 36 pass through openings formed in the waler 44. The ends of the inner member 36 are secured to the waler 44 as by securing nuts 46. As best seen in FIG. 3, the second set of soil nails 30 are slightly offset from the soil nails 12 so that the second set of soil nails 30 may also be tied to the soil nails 12, such as by wire ties.

Additional reinforcement for the system may be provided by a plurality of shear resisting soil nails or dowels 60. As shown, these soil nails or dowels 60 are shortened nails that are dispersed along the slope 28 in a desired pattern. The soil nails or dowels 60 may be installed for example by drilling or launched from a soil nail launching device.

Once the soil nails 12 and 30, wire mesh layer 14, geotextile layer(s) 16, nails/dowels 60 and walers 44 are installed, the generally V-shaped space or gap between the slope 28 and the geotextile layers(s) 16 may be filled with desired materials 49. The materials 49 may include light weight concrete mix, soil, lyme, aggregates, rip wrap, or combinations thereof.

A roadway barrier 70 may be installed to provide the necessary lateral barrier protection to prevent vehicles from driving off the edge of the roadway. In the example of FIG. 1, the barrier 70 may include a plurality of vertical posts 74 secured to the backfill material 49 as by anchor bolts 72. One or more horizontal barrier members 76 are then secured to the vertical posts 74 as by fasteners 78.

The increased roadway width is shown as distance 26. This increased roadway width is achieved with a minimum amount of backfill 49, since the lower most point or edge 66 of the retaining wall 10 can commence at an elevation which is a reasonable distance below the roadway, as compared to a traditional retaining wall that may have to extend hundreds of feet below the roadway.

Referring to FIG. 3, this plan view illustrates the general spacing and orientation of the soils nails 12, 30 and the dowels 60. Some of the soil nails 12 are not illustrated in dotted lines for clarity purposes. The roadway barrier 70 is also not shown to better illustrate the arrangement of the soil nails 12 and longitudinal waler 44. In addition to the longitudinal waler 44, a laterally extending waler 90 may be used to support the lateral ends or sides 68 of the retaining wall 10, along with a plurality of laterally extending soil nails 92. This set of laterally extending soil nails 92 can be aligned linearly in the lateral or transverse direction, thereby resulting in the soil nails 92 being installed at various elevations along the slope 28. A bracket or tie 94 can be used to interconnect the ends of the lateral waler 90 to the ends of the longitudinal waler 44.

The exposed face of the retaining wall 64 may be treated with a layer of sealing material, such as Shotcrete™ or other exterior surface treatments, including other types of concrete, plasters, stains, and paints. The selected sealing/treatment material can match the color and other aesthetic characteristics of the environment, thereby resulting in a natural and non-obtrusive appearing roadway extension.

A considerable amount of time and materials savings may be realized by the system and method of the present invention. The vertical line 48 represents the location of the typical prior art retaining wall that must extend a substantial distance below the roadway, as compared to the retaining wall 10 of the present invention. The prior art retaining wall would also require footers or other subsurface supports to support the retaining wall. The emplacement of these subsurface supports may be particularly time consuming, as compared to the emplacement of soil nails, that can be emplaced by drilling or by a soil nail launcher that is positioned on the existing roadway.

In another aspect of the invention, the retaining wall may be conceptually viewed as a retaining structure that is held in a cantilevered position by subsurface supports which are secured in the underlying geological formation directly under the roadway. This cantilevered structure can be quickly installed with soil nails, which eliminates the prior art disadvantages with respect to footers/pilings and a vertically extending retaining wall.

Once the backfill material 49 has been compacted and/or cured, the roadway surface 56 can be extended onto the increased roadway width 26. A thermal expansion joint 58 may be placed at the location where the roadway extension joins the lateral edge of the existing roadway.

FIG. 1 also illustrates a facing rock wall or hill 54 that prevents the roadway from being widened in that direction, as substantial blasting would have to occur to make the roadway wider on that lateral side. As mentioned, regulatory constraints in terms of blasting and earth removal may make extension of the roadway in that direction impractical. Furthermore, it is well-known that such significant blasting or earth work requires intermittent road closures and significant equipment/manpower. Accordingly, the system and method of the present invention provide a superior solution.

Figure 2:
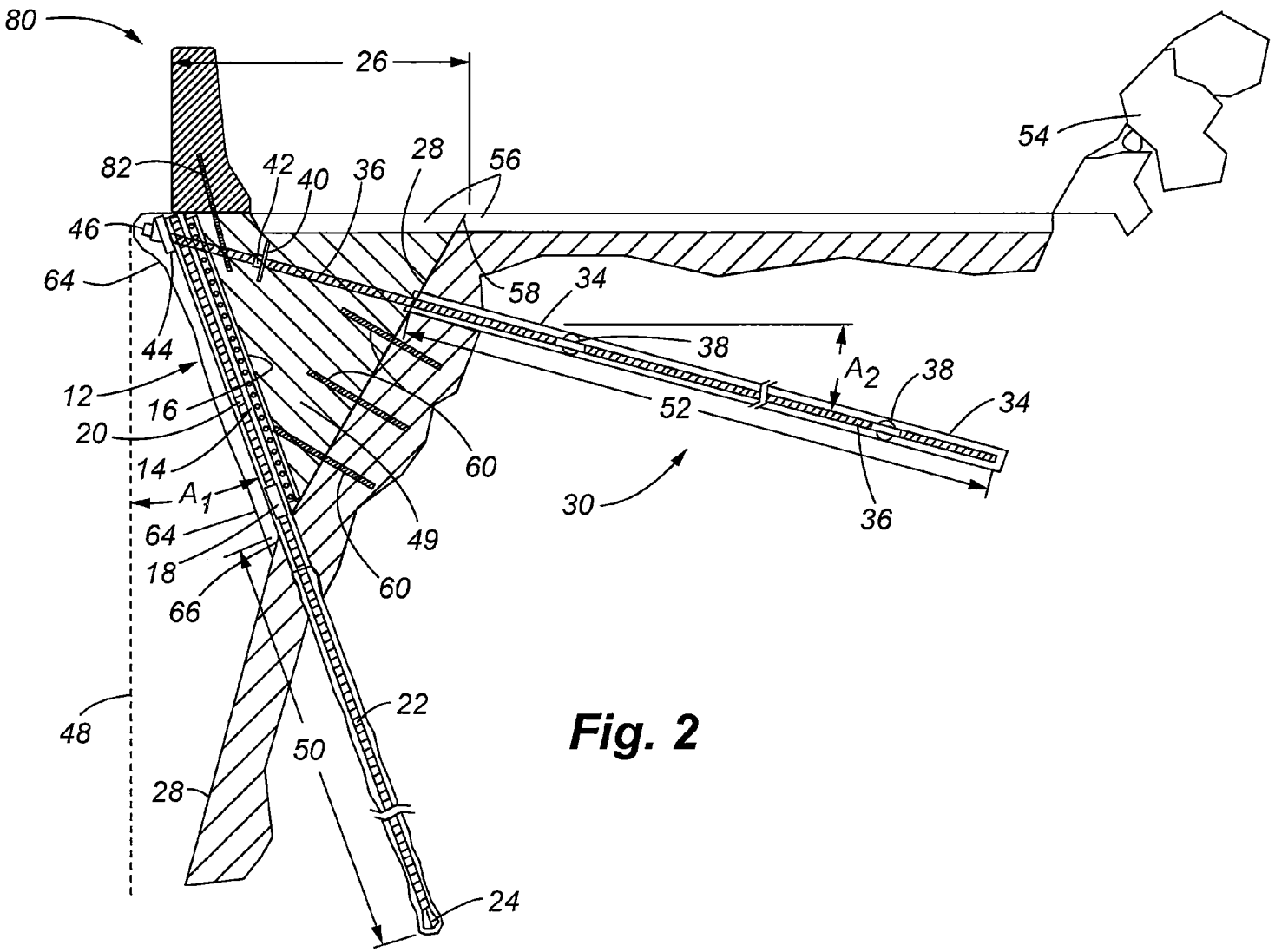
FIG. 2 is a cross-sectional view of another embodiment of the present invention showing a different type of lateral roadway barrier.

FIG. 2 illustrates another embodiment of the invention, which may include the same retaining wall structure, but a different type of roadway barrier. The barrier 80 in FIG. 2 is shown as a traditional concrete barrier that is secured as by one or more rebar anchors 82 embedded in the backfill material 49.

In accordance with the method of the present invention, a roadway width may be increased by incorporating of a reverse-oriented retaining wall. This reverse-oriented or cantilevered retaining wall maintains a reverse-orientation such that the exposed face of the retaining wall has a reverse or concave angle $A_1$, as compared to a traditional vertical retaining wall. The method includes the emplacement of at least two sets of soil nails, a first set that extends substantially parallel to the reverse angle $A_1$ and a second set of soil nails that extend at a more horizontal orientation, such as defined by angle $A_2$. The method further contemplates the use of one or more supporting and barrier layers, such as a wire mesh layer and one or more geotextile layers that define the exterior shape of the retaining wall. The method may also include the use of one or more smaller soil nails or dowels to further provide subsurface support against shearing. Backfill material fills the gap between the existing slope and the retaining wall. The roadway extension can be increased either by increasing the reverse angle at which the first set of soil nails extend, and/or spacing the first set of soil nails further away from the lateral edge of the existing roadway.

Figure 6:
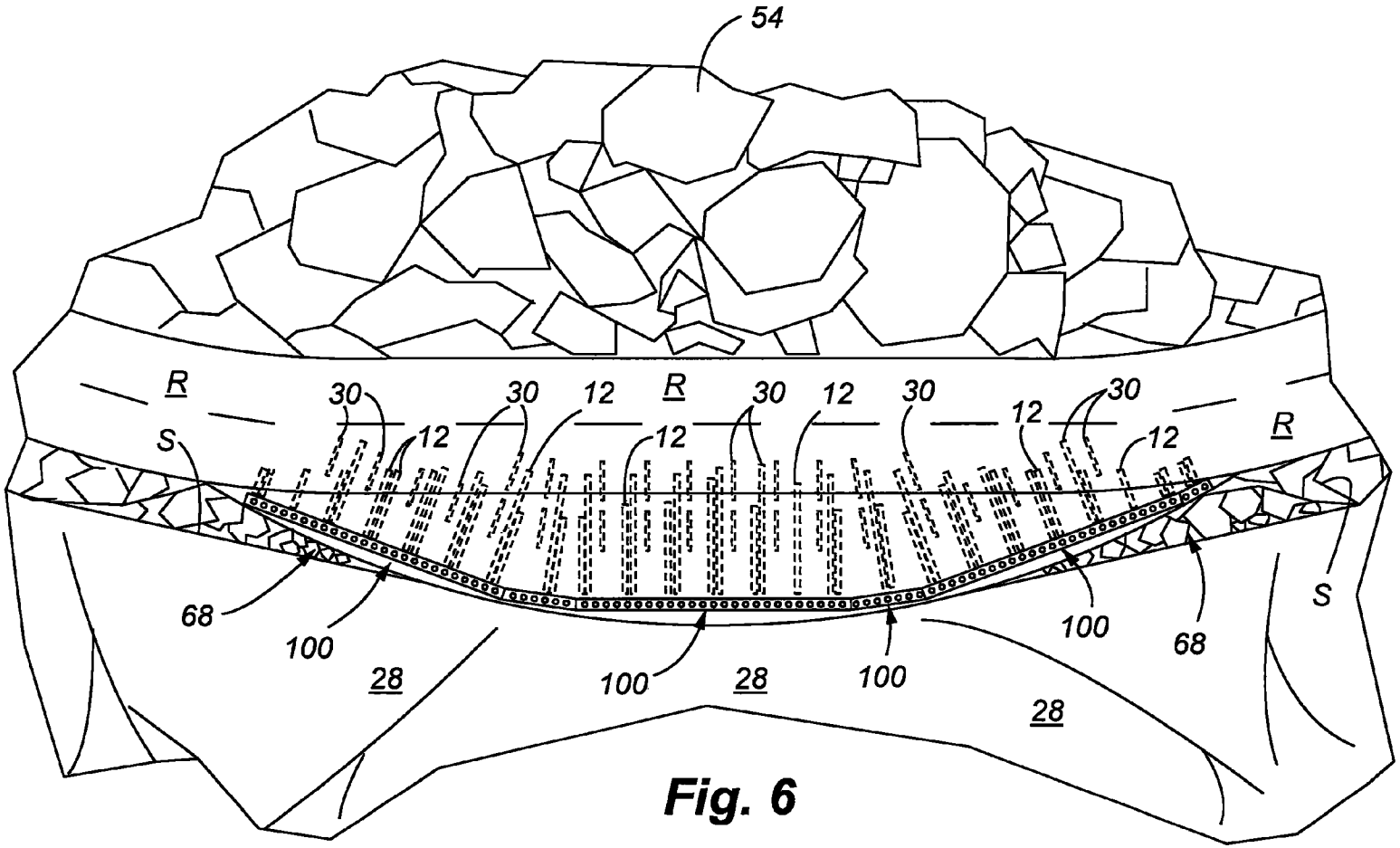
FIG. 6 is a plan view of yet another embodiment showing the system in which the lateral ends or sides of the retaining wall system have widths that gradually become smaller resulting in a curved shaped retaining wall.

The width 26 of the roadway extension can vary based upon the pattern of the first set of soil nails 12 when installed. For example, the roadway width along a particular section of the road may only require minimal widening, while another section of the roadway may require much greater widening. Accordingly, the first set of nails 12 can be selectively spaced either higher or lower upon the sloping surface 28, and the width 26 of the roadway extension would therefore vary depending upon the distance from the upper ends of the first set of nails 12 to the lateral edge of the existing roadway. Because the wire mesh and geotextile material are flexible, changes to the locations of the first set of nails can be accommodated to create a retaining wall that has a limitless number of shapes or orientations. Therefore, the system and method of the present invention are quite adaptable for providing selected roadway width extensions for any areas of a roadway. This flexibility further provides savings both in time and materials in that a nonlinear retaining wall can be built without requiring a complex underlying system of pilings. FIG. 6 discussed below provides an example of the retaining wall in which the width of the retaining wall varies over the length of the retaining wall including tapering lateral ends.

Figure 4:
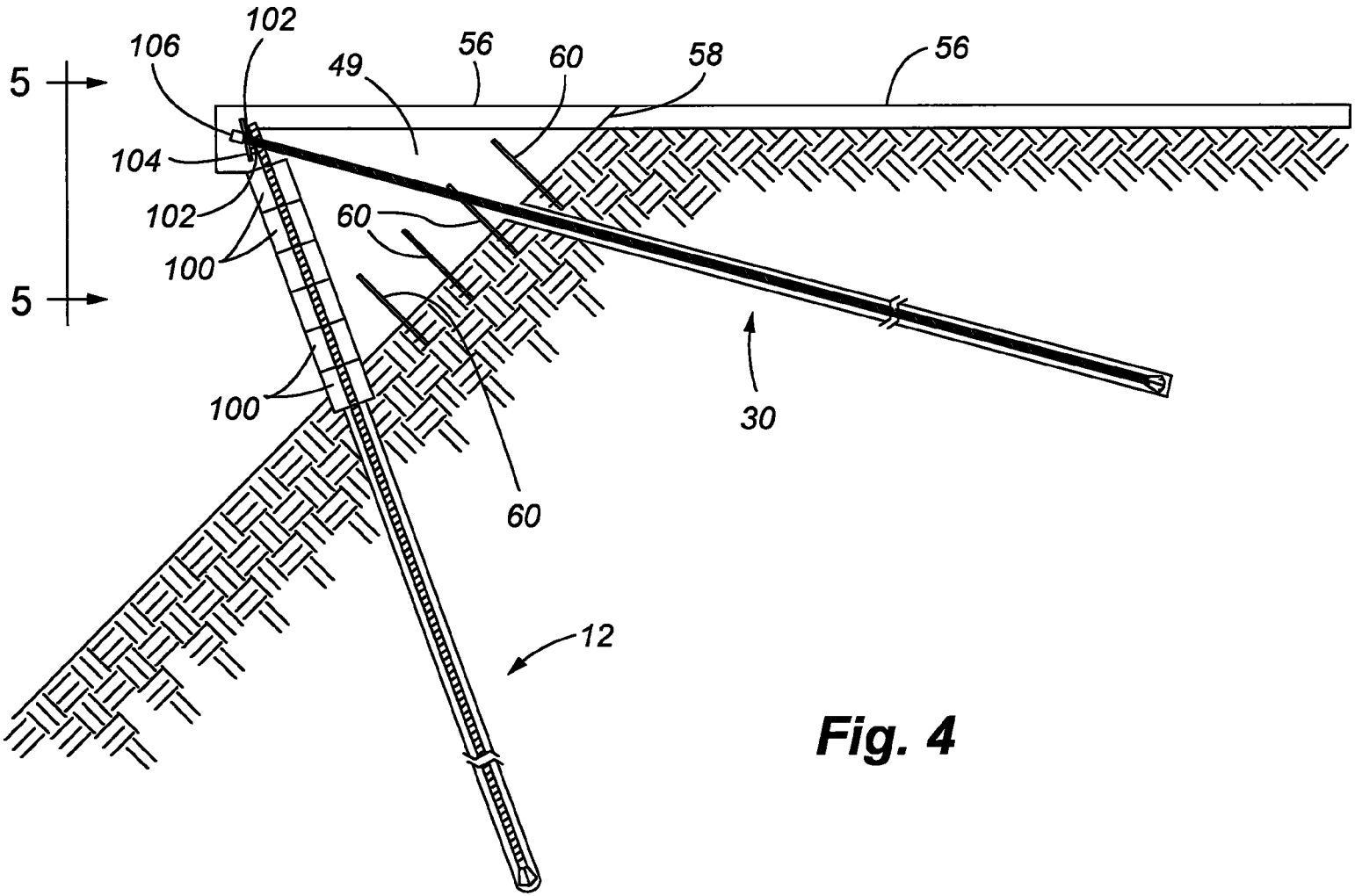
FIG. 4 is a cross-sectional view of another embodiment of the present invention showing a retaining wall made with CMU blocks mounted over the first set of nails.

FIG. 4 illustrates another embodiment of the present invention in which the exterior retaining wall is formed by a plurality of CMU blocks. As shown, the CMU blocks are placed over the first set of nails 12, and are uniformly stacked on one another to form a block wall. Mortar is used between the blocks in a conventional brick and mortar construction technique. Additionally, the CMU blocks may be filled with mortar or other fill material which further assists in securing the blocks 100 to the first set of nails 12. Also referring to FIG. 5, it is shown that the CMU blocks may include the lower row that is partially covered with earth, while the remaining blocks extend above the sloping surface of the ground. It is not necessary to have CMU blocks with multiple rows that are supported by separate footers, since the first set of nails 12 act as robust subsurface anchors. Thus, the benefits of a block wall can be achieved without the cost and additional effort to install separate footers.

Figure 5:
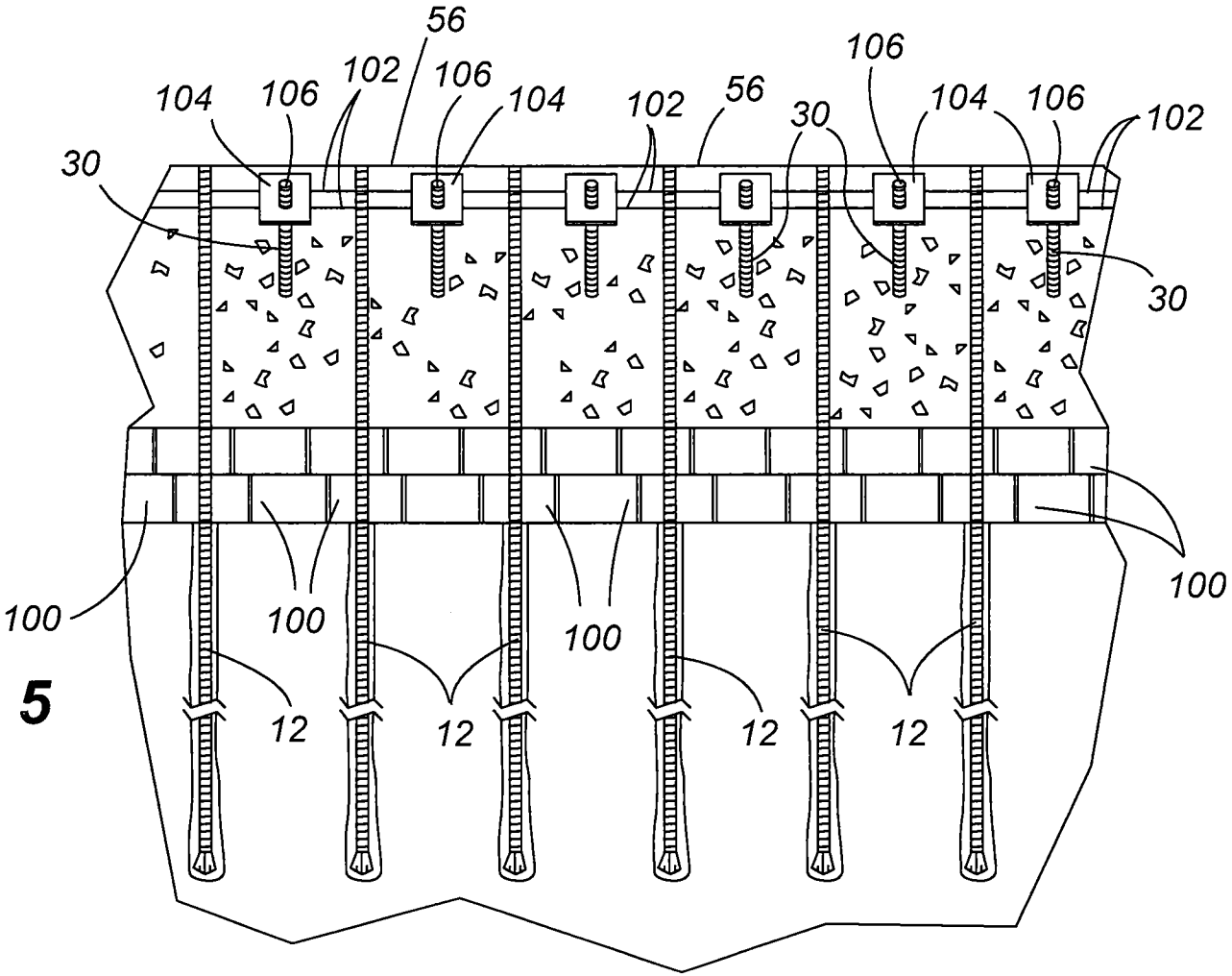
FIG. 5 is a fragmentary elevation view of the embodiment of FIG. 4 taken along line 5-5 of FIG. 4.

In addition to the use of the CMU blocks, the embodiment of FIGS. 4 and 5 utilize a pair of horizontally extending lengths of rebar 102 instead of the waler 44 used in the prior embodiment. As shown, the rebar 102 extend substantially parallel to the direction of the roadway adjacent to the exposed ends of the first and second plurality of soil nails.

Additionally, this embodiment makes use of a plurality of steel bearing plates 104 that can be tied to the rebar 102. The bearing plates 104 each have a central opening to receive the protruding ends of the second set of nails 30. The ends of the nails 30 may receive securing nuts 106, similar to the securing nuts 46. Accordingly, the lengths of rebar 102 provide additional strength and rigidity to the upper portion of the retaining wall without the need for external anchors or tie downs. The first and second sets of nails in this embodiment are shown as being drilled soil nails with self-drilling bits 24; however, it shall be understood that the soil nails 12 and 30 of this embodiment can also be any of the other soil nail constructions discussed above.

FIG. 6 shows an example of the retaining wall of the present invention in which the width of the retaining wall system varies over the length of the retaining wall. More specifically, the retaining wall system tapers or reduces in width at both ends 68 of the retaining wall as the width of the shoulder S of the road R increases. The system of the invention is adaptable to be installed with varying widths, for example, a curved road R and to accommodate the surrounding terrain. FIG. 6 is intended to show an adjacent sloping surface 28 that is very steep, such as a cliff, wherein the cliff terminates with a raised elevation at shoulders S that are close to or at the level of the road R. Accordingly, as the cliff terminates, the width of the retaining wall at those locations can be narrower since the shoulder of the road S is at or near the grade elevation of the roadway surface. As mentioned above, the first and second set of nails can be adjusted in length to accommodate the necessary roadway width along the length of the retaining wall resulting in a curved shape retaining wall. FIG. 6 shows the use of a block wall 100 however, the curved shape retaining wall could be built according to the embodiment of FIGS. 1-3. For clarity, some but not all of the soil nails 12 and 30 are illustrated in this FIG. 6.

Figure 7:
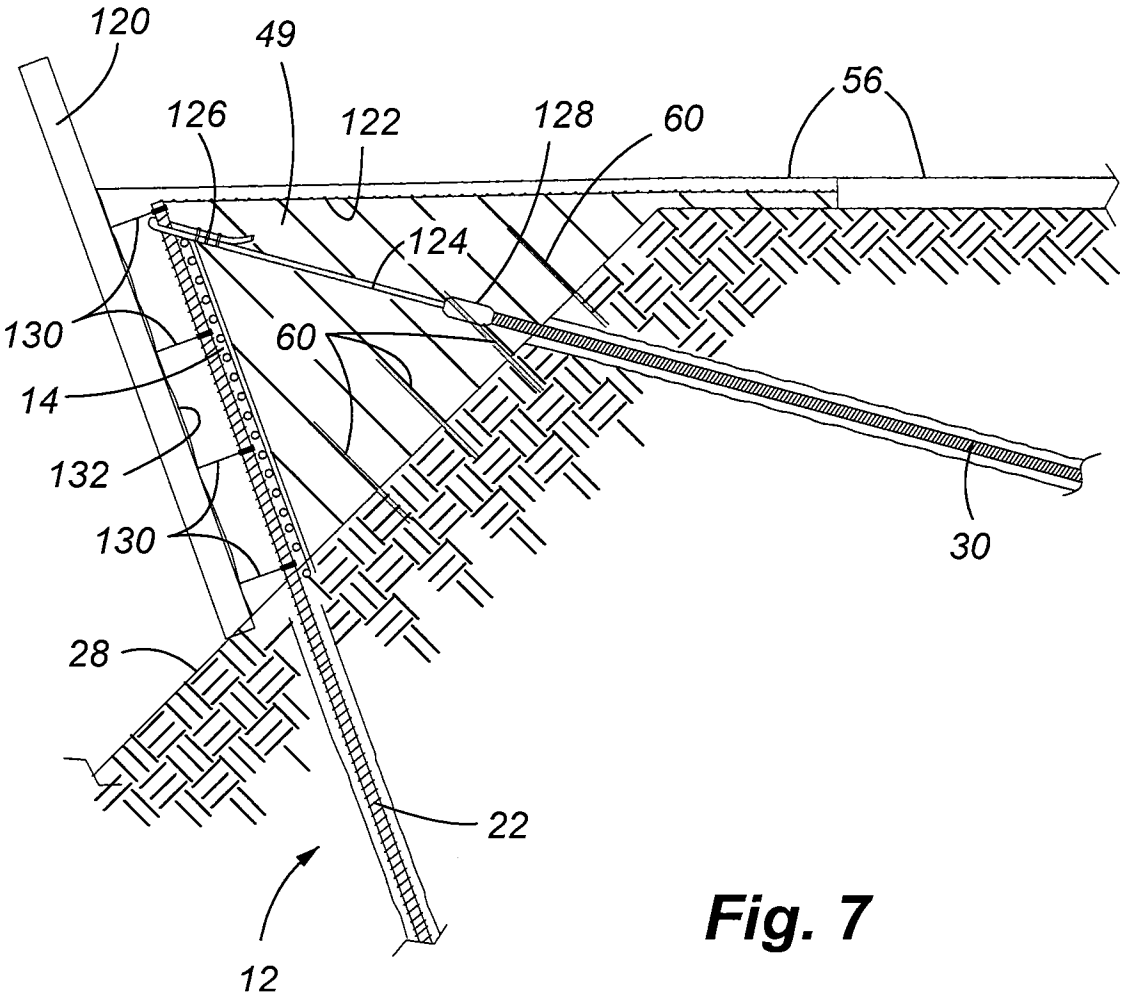
FIG. 7 is a cross sectional view of another embodiment of the present invention showing a retaining wall constructed with the use of a form panel and use of cables for interconnecting the first and second sets of soil nails.

FIG. 7 illustrates another embodiment of the present invention using a form panel 120 to form the exposed edge or side of the retaining wall, and to support the retaining wall during construction. As shown, the form panel 120 is placed at the desired reverse orientation, and is then secured to the first set of nails 12 as by plurality of tie rods 130. The retaining wall can be filled with concrete along the form panel thereby forming an exterior concrete wall. Optionally, a decorative liner 132 is placed against the interior surface of the form panel 120. When the form panel is stripped from the retaining wall after the concrete has cured, the decorative panel 132 is exposed. The decorative panel can be colored or otherwise textured with a desired appearance. Form panel 120 is removed by cutting the tie rods 130, thereby freeing the form panel from the retaining wall. The remaining fill material 49 between the sloping surface 28 and the concrete exterior wall may include combinations of other materials, the same as mentioned above. FIG. 7 also illustrates a wire mesh material 14 that can be placed against the first set of nails, which also facilitates the formation of a steel reinforced concrete wall along the form panel 120. The width of the concrete wall can therefore cover the first set of nails 12 and the wire mesh 14.

FIG. 7 also illustrates the use of a laterally extending cable 124 that interconnects the exposed end of one of the second set of nails 30 to a facing nail of the first set of nails 12. More specifically, the exposed end of the nail 30 may include a coupler 128 that interconnects the lateral cable 124 to the end of the soil nail. The coupler 128 may be, for example, threaded at one end to receive a threaded end of the nail 30, and the other end of the coupler 128 may include a clamp that holds the cable 124 to the coupler. The free end of the cable 124 is then secured to the soil nail 12, such as by a cable clamp 126. The use of a cable 124 to interconnect the first and second sets of soil nails enables the cable to be selectively tensioned in order to firmly interconnect sets of soil nails to one another. The use of the cables 124 also provide flexibility in construction in that the exposed ends of the nails 30 may protrude at different lengths and angles from the sloping surface 28. Therefore, the lengths of the cables 124 can be adjusted to allow the cables to interconnect the opposing sets of nails 12 and 30. FIG. 7 also illustrates the use of at least one layer of a wire mesh material 122 that extends substantially horizontally with the road bed. This layer of wire mesh material may provide further support to the retaining wall, as well as to supplement support when concrete is used as the roadway surface 56.

Figure 8:
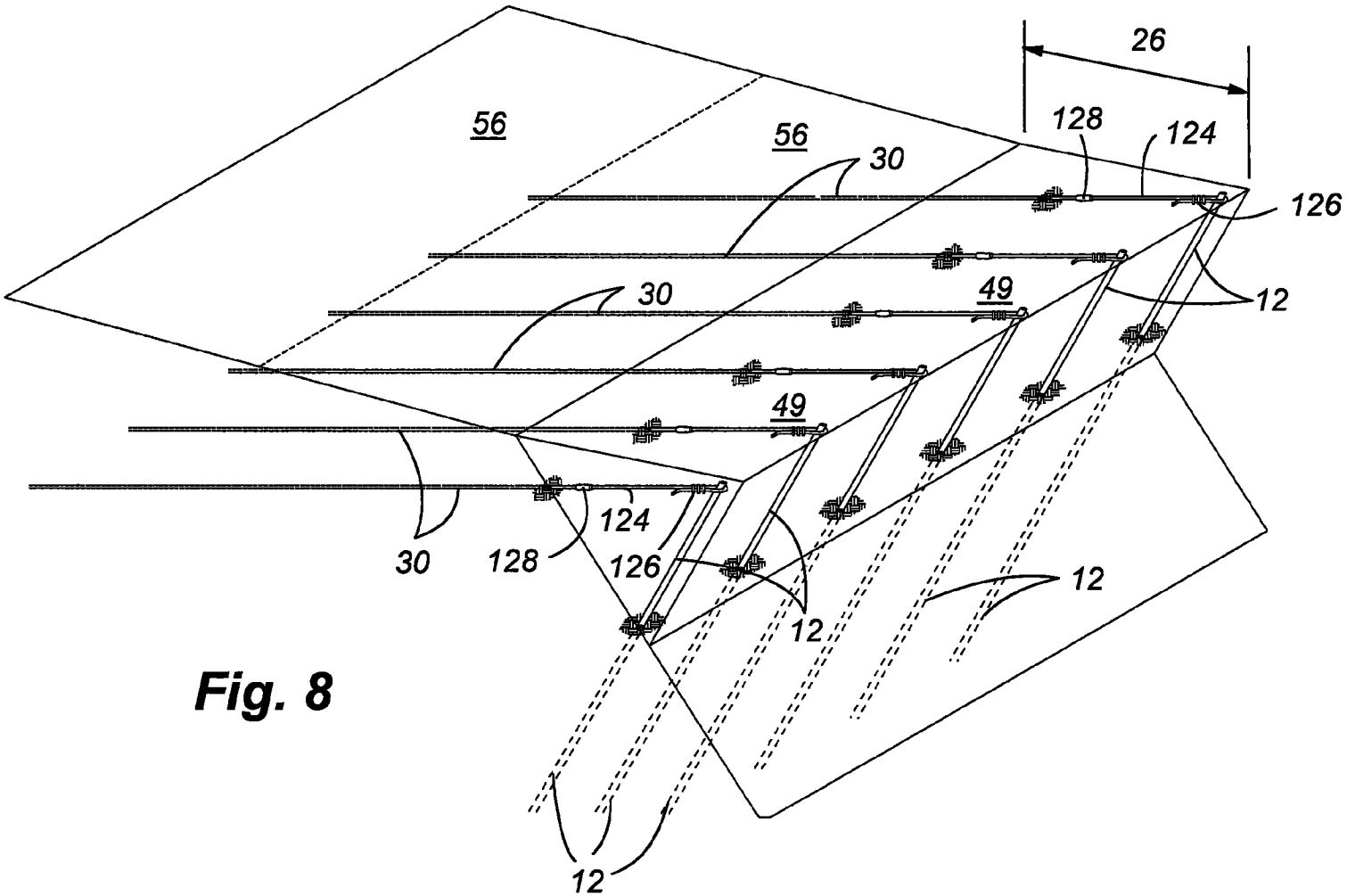
FIG. 8 is a simplified perspective view of the embodiment of FIG. 7 illustrating the arrangement of the cables interconnecting the first and second sets of soil nails.

FIG. 8 is a simplified perspective view showing the use of the cables 124 for interconnecting the first and second sets of soil nails to one another. As shown, there is a one to one correspondence in this Figure in terms of interconnecting each nail 30 with a corresponding facing nail 12. The other elements in the retaining wall have been eliminated in this Figure for clarification to better show the interconnection of the soil nails by use of the cables 124.

Figure 9:
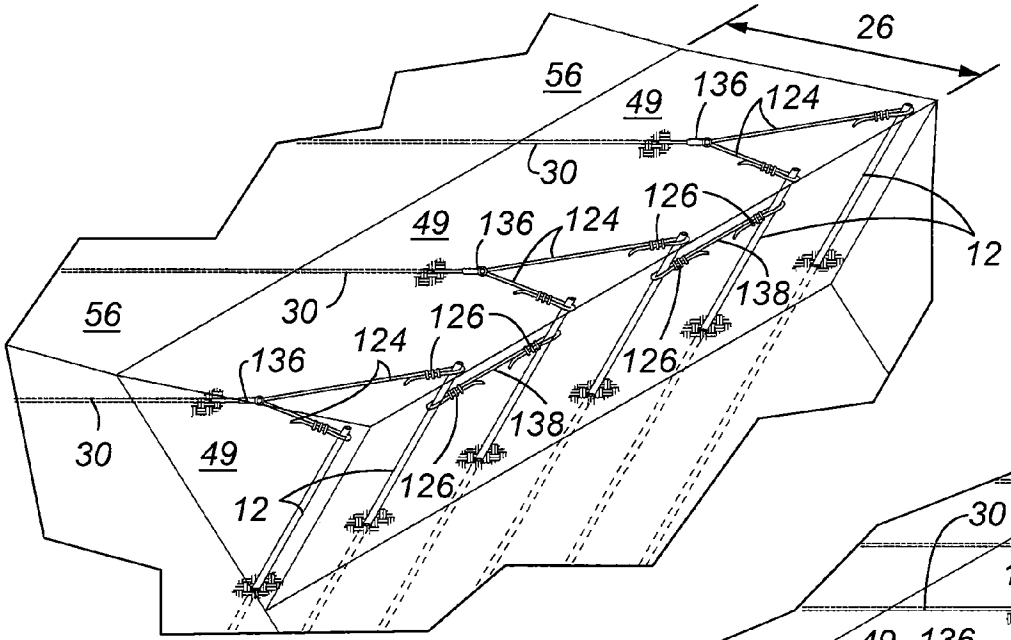
FIG. 9 is another simplified perspective view of the embodiment of FIG. 7 illustrating another arrangement for the cables interconnecting the first and second sets of soil nails.

FIG. 9 illustrates another arrangement of the cables 124 in which one soil nail 30 attaches to two nails 12 by use of a coupler 136 having an eye or ring that allows the cable 124 to be routed through the ring. Therefore, in the example of FIG. 9, the number of nails 30 is reduced as compared to FIG. 8. As shown, a single nail 30 can be secured to a pair of nails 12 by routing the cable 124 through the ring of the couplers 136. The cables 124 extend substantially horizontally between the nails. FIG. 9 also illustrates the use of longitudinal cables 138 which may longitudinally interconnect the exposed ends of the nails 12. These cables 138 may be secured to the nails 12 as by cable clamps 126. Additional structural strength and rigidity can be obtained by a selected configuration of the cables 124 and 138.

Figure 10:
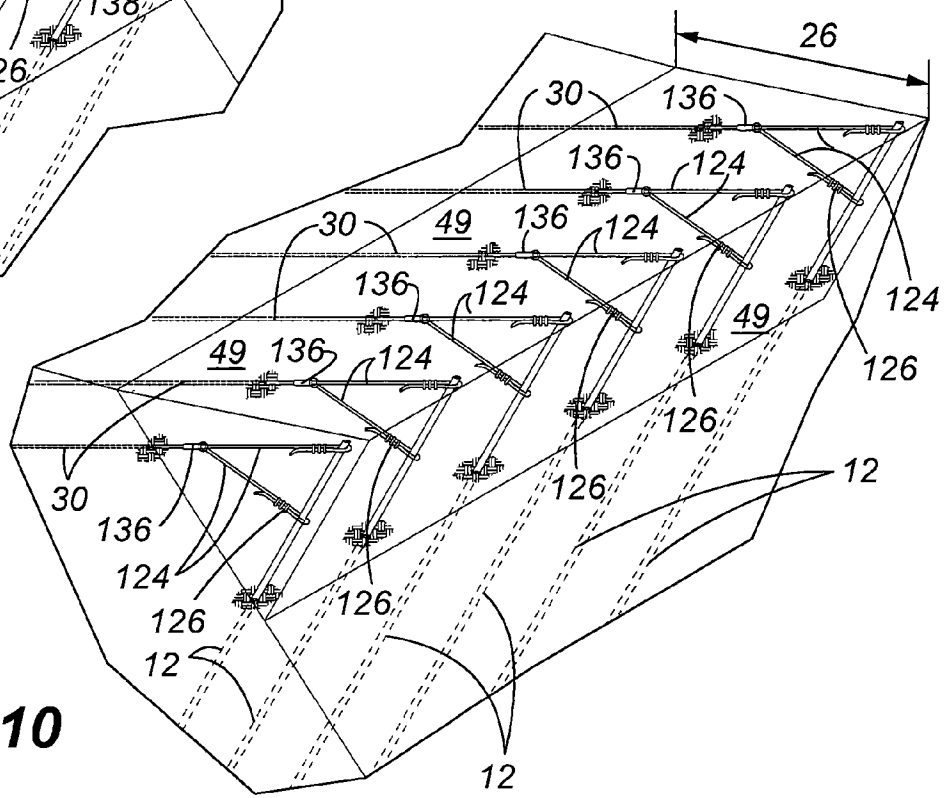
FIG. 10 is yet another simplified perspective view of the embodiment of FIG. 7 illustrating yet another arrangement of cables for interconnecting the first and second sets of soil nails.

FIG. 10 shows yet another example in which the nails 30 and nails 12 may be interconnected to one another. In the example of FIG. 10, the couplers 136 are rotated so that the cables may attach to two separate vertical locations on the nail 12. The FIGS. 8-10 show that the cables 124 can be arranged in various vertical, angular, or horizontal orientations. This flexibility in design allows the cables to provide additional strength without having to re-arrange the basic combination of the first and second sets of soil nails.

While the system and method of the present invention have been set forth with respect to preferred embodiments, it shall be understood that various other changes and modifications may be made within the scope of the claims appended hereto.

What is claimed is:

1. A method of constructing a retaining wall system constructed on a sloping surface having a sloping grade extending away from an adjacent side of a roadbed of a road, the method comprising:

embedding a first plurality of soil nails having first ends in the sloping surface, said first plurality of nails having second exposed ends extending away from the sloping surface;

placing a wire mesh material over the first plurality of soil nails and securing the wire mesh material to the first plurality of soil nails;

embedding a second plurality of soil nails having first ends embedded in the sloping surface and having second exposed ends extending away from the sloping surface;

forming an exterior wall adjacent the first plurality of soil nails wherein said exterior wall extends at a reverse orientation, and a gap being located between the exterior wall and the adjacent side of the roadbed;

filling the gap with backfill material; and placing a road surface over the backfill material thereby creating a lateral roadway extension of the road.

2. A method, as claimed in claim 1, further including:

securing a plurality of shear resisting dowels each having a first end secured in the sloping surface, and having a second end extending into the backfill material.

3. A method, as claimed in claim 1, further including:

applying a treatment to exposed surfaces of the first plurality of soil nails and, wire mesh material, the surface treatment including at least one of concrete, plaster, stain, and paint.

4. A method, as claimed in claim 1, further including:

placing a longitudinal waler adjacent to the exposed ends of the first and second plurality of soil nails and secured to the exposed ends of the first plurality of soil nails.

5. A method, as claimed in claim 1, wherein:

at least one of the first and second plurality of soil nails includes two sections interconnected by a coupler.

6. A method, as claimed in claim 1, wherein:

at least one of the first and second plurality of soil nails includes a tubular outer member, an inner member, and a centering feature disposed in the outer member for concentrically spacing the inner member within the outer tubular member.

7. A method, as claimed in claim 1, wherein:

the first plurality of soil nails extending at a first reverse angle as measured from a vertical line;

the second plurality of soil nails extending at a second angle and extending more horizontally as compared to the first plurality of soil nails.

8. A method, as claimed in claim 7, wherein:

the first plurality of soil nails extend at the first reverse angle that substantially defines the shape of an exterior exposed surface of the retaining wall.

9. A method, as claimed in claim 1, further including:

securing at least one bearing plate to a soil nail of the first or second plurality of soil nails.

10. A system, as claimed in claim 1, further including:

mounting a roadway barrier to an upper surface of the roadway extension.

11. A method, as claimed in claim 1, further including:

placing a laterally extending waler extending substantially perpendicular to the first plurality of soil nails.

12. A method, as claimed in claim 1, further including:

placing a longitudinal waler adjacent to the exposed ends of the first and second plurality of soil nails and secured to the exposed ends of the first plurality of soil nails; and placing at least one lateral waler extending laterally as compared to the first plurality of soil nails.

13. A method, as claimed in claim 1, further including:

placing a geotextile material over the wire mesh material prior to said filling step, and securing the geotextile material to the wire mesh material.

14. A method, as claimed in claim 1, wherein:

forming said exterior wall includes placing a plurality of blocks over or adjacent to the first plurality of soil nails, and stacked on one another forming a block wall.

15. A method, as claimed in claim 1, wherein:

said backfill material filling said gap forms a generally V-shape.

16. A method, as claimed in claim 1, further including:

placing at least one length of rebar extending substantially parallel to the roadway adjacent to said exposed ends of the first and second plurality of soil nails, and secured to at least one of the exposed ends of the first and second soil nails.

17. A method, as claimed in claim 1, further including:

embedding a plurality of shear resisting dowels each having a first end secured in the sloping surface, and having a second end extending into the backfill material.

18. A method, as claimed in claim 1, further including:

connecting a plurality of bearing plates to corresponding exposed ends of said second set of soil nails.

19. A method of constructing a retaining wall system constructed on a sloping surface having a sloping grade extending away from an adjacent side of a roadbed of a road, the method comprising:

embedding first ends of a first plurality of soil nails in the sloping surface, and the first plurality of soil nails having second exposed ends extending away from the sloping surface;

placing a plurality of blocks over the first plurality of soil nails and stacked on one another forming a block wall;

embedding first ends of a second plurality of soil nails in the sloping surface, and the second plurality of soil nails having second exposed ends extending away from the sloping surface;

securing at least one length of rebar to at least one of the exposed ends of the first and second soil nails;

placing backfill material in a gap between the sloping surface and the block wall, and when viewing the retaining wall from a vertical cross-section, the backfill material having a generally V-shape; and wherein the backfill material has one side thereof abutting a lateral edge of the roadbed and a road surface placed over the backfill material thereby creating a lateral roadway extension of the road.

20. A method, as claimed in claim 19, wherein:

said at least one length of rebar extends substantially parallel to the roadway adjacent to the exposed ends of the first and second plurality of soil nails.

21. A method of constructing a retaining wall system constructed on a sloping surface having a sloping grade extending away from an adjacent side of a roadbed of a road, the method comprising:

installing a first plurality of soil nails spaced apart from a lateral side of the road, the first plurality of soil nails extending at a reverse angle, and the first plurality of soils nails secured in the sloping surface adjacent to the road;

providing a plurality of blocks and mounting the blocks to extend adjacent with or over the first plurality of soil nails thereby forming a block wall aligned at said reverse angle; and filling a gap between the sloping surface and an exterior wall formed by the block wall, the backfill material having an upper surface that is near an elevation as the road, and a width of the upper surface defining a lateral roadway extension of the road.

22. A method, as claimed in claim 21, further including:

installing a second plurality of soil nails in the sloping surface adjacent the first plurality of soil nails, wherein the second plurality of soil nails extend at a more horizontal angle as compared to the reverse angle of the first plurality of soil nails.

* * * * *